United States Patent [19]

Robison

[11] 4,136,542

[45] Jan. 30, 1979

[54] SECURITY LOCKING BOX

[76] Inventor: Allen M. Robison, 3731 Stevely Ave., Long Beach, Calif. 90808

[21] Appl. No.: 786,759

[22] Filed: Apr. 12, 1977

[51] Int. Cl.[2] ..... E05B 37/20

[52] U.S. Cl. ..... 70/290; 206/1.5; 273/113; 273/153 R

[58] Field of Search ..... 70/276, 289, 290; 206/1.5; 273/109, 113, 153 R

[56] References Cited

U.S. PATENT DOCUMENTS

| | | | |
|---|---|---|---|
| 403,012 | 5/1889 | Washburn | 273/109 |
| 558,066 | 4/1896 | Happersett | 273/113 |
| 612,572 | 10/1898 | Robertson | 70/289 |
| 753,355 | 3/1904 | Bruck | 206/1.5 |
| 1,714,019 | 5/1929 | Gornicec | 70/290 X |
| 1,733,772 | 10/1929 | Battersheu | 206/1.5 |
| 3,234,767 | 2/1966 | Allander | 70/276 |
| 3,406,971 | 10/1968 | Koff | 273/109 |
| 3,540,731 | 11/1970 | Moncey | 273/109 |
| 3,785,651 | 1/1974 | Smith | 273/113 |
| 3,787,054 | 1/1974 | Stafford | 273/109 |

FOREIGN PATENT DOCUMENTS

| | | | |
|---|---|---|---|
| 947437 | 1/1949 | France | 70/289 |
| 428438 | 12/1947 | Italy | 70/290 |
| 581667 | 9/1958 | Italy | 273/113 |
| 752110 | 7/1956 | United Kingdom | 273/109 |

OTHER PUBLICATIONS

Prof. A.M. Low "Wizard's Boxes" Popular Science, Mar. 1953, pp. 188–191.

*Primary Examiner*—Thomas J. Holko
*Attorney, Agent, or Firm*—Fulwider, Patton, Rieber, Lee & Utecht

[57] ABSTRACT

There is disclosed a lock mechanism requiring movement through an enabling combination of preselected, sequential positions for operation. The lock mechanism is preferably embodied in a locking box and includes a latch formed with a pair of opposed hooks that capture a retainer of the box cover. The opposed hooks are carried on separate members yieldably interconnected. Release of the lock requires positioning a ball in an actuation cavity to block movement of one of the members, thereby permitting the hooks to be separated, releasing the retainer pin carried by the box cover. The ball is positioned in the actuation cavity by advance through a torturous passageway of a three-dimensional labyrinth within the box. Passageway defining partitions of the labyrinth have apertures at preselected locations to provide the desired, preselected sequential combination of positions. The partitions are removeable, reversible and/or interchangeable to permit changing of the combination and can have bypass apertures to further increase the complexity of the enabling combination of positions.

9 Claims, 11 Drawing Figures

FIG. 1
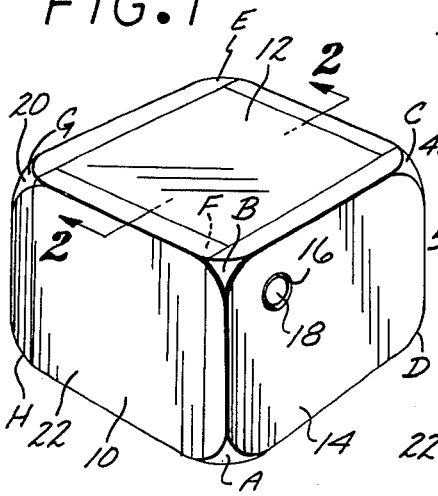
FIG. 2
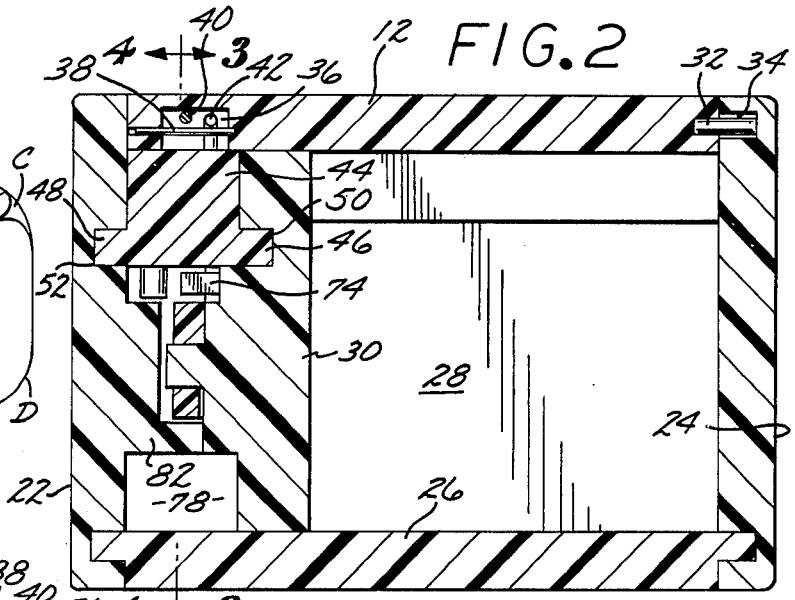
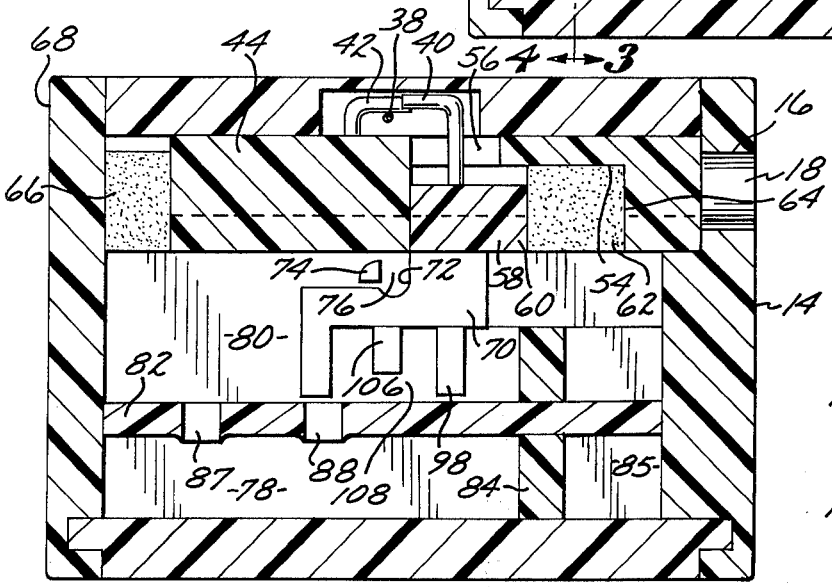
FIG. 3
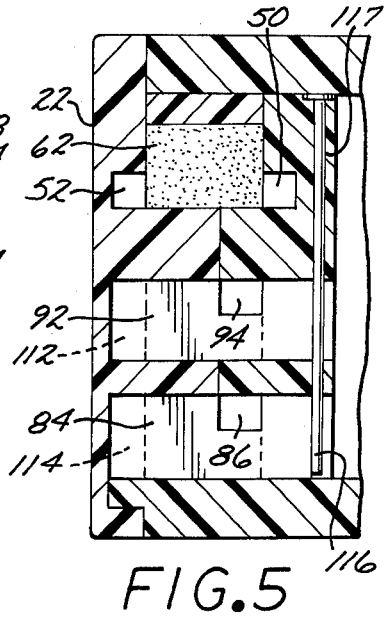
FIG. 5
FIG. 4
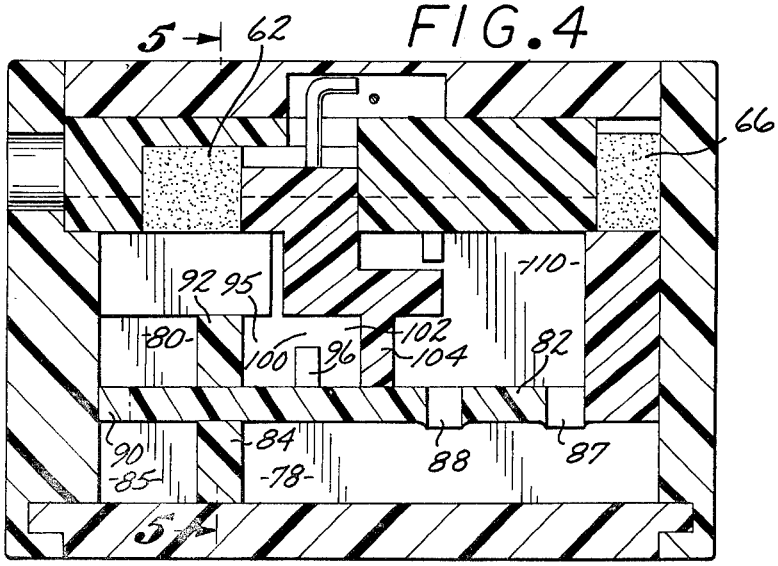
FIG. 6
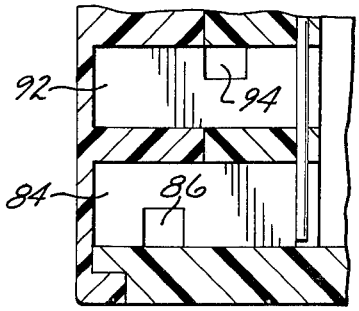

FIG. 7
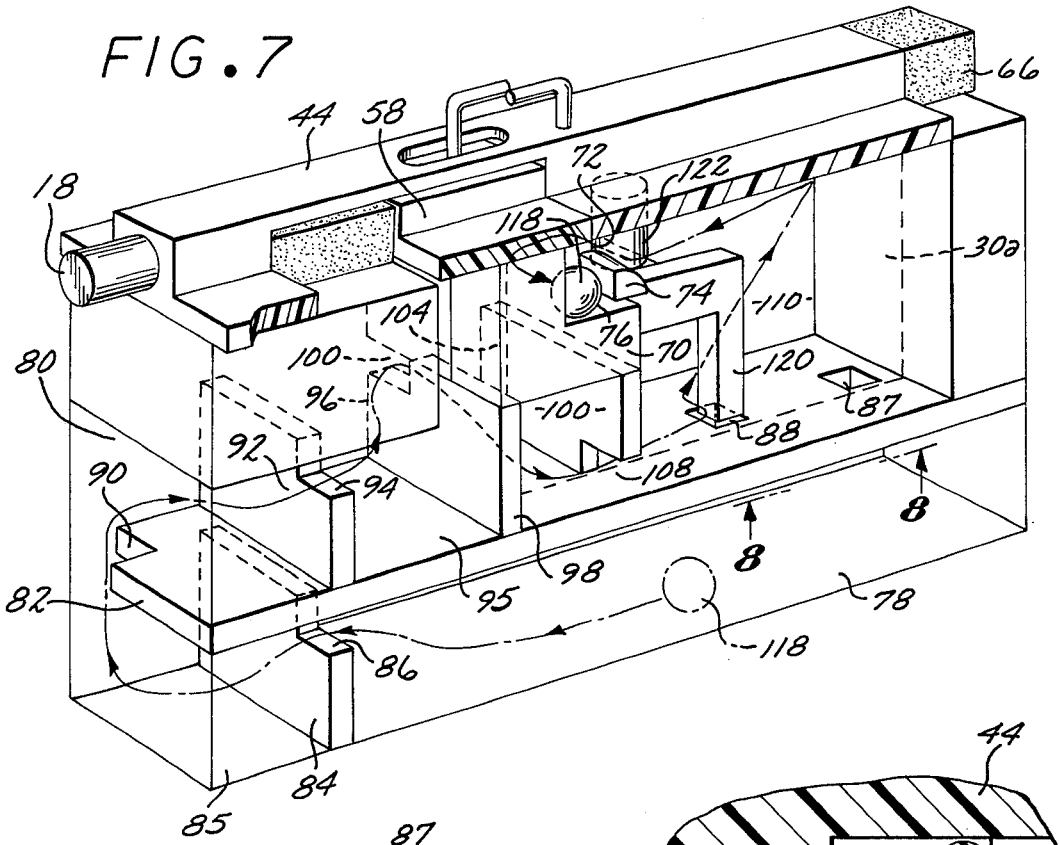
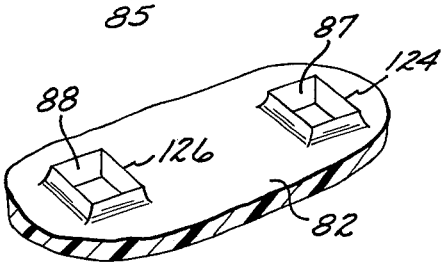
FIG. 8
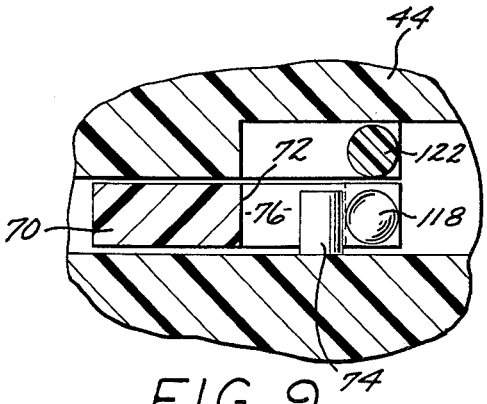
FIG. 9
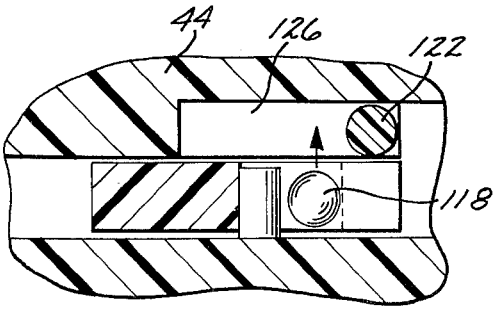
FIG. 10
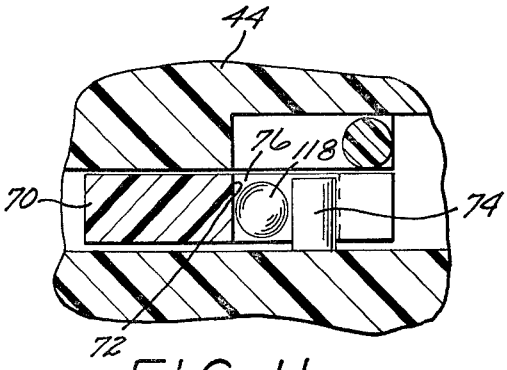
FIG. 11

SECURITY LOCKING BOX

BACKGROUND OF THE INVENTION

1. Field of the Invention

This invention relates to a lock mechanism and, in particular, to a locking box having said lock mechanism.

2. Brief Statement of the Prior Art

Locking mechanisms having detenting balls which must be moved into or out of detenting positions to enable operation of the latch of the locking mechanism have been described in prior patents. U.S. Pat. No. 1,714,019 discloses a padlock in which a ball is interposed between the hasp and latch members to permit movement of the latch out of its hasp engaging position. The ball is transported to its operative, detenting position through a labyrinth, thereby defining an enabling sequence of lock positions.

U.S. Pat. No. 1,733,772, discloses a locking box having a keeper bolt which engages a hasp. The cover of the box receives the keeper bolt and has two obstructing, sliding bolts that are retained in obstruction to movement combination the keeper bolt by a plurality of balls. The enabling combination of positions for this box results in movement of the balls out of their detenting positions, freeing the obstructing rods for movement out of the path of the keeper bolt, and permitting movement of the keeper bolt to release the hasp.

While the aforedescribed attempts have been made to provide a lock mechanism requiring movement through a preselected sequence of positions, no attempt has been made to provide a maximum complexity of such a lock mechanism nor to provide interchanging of the combination of such a lock mechanism.

BRIEF STATEMENT OF THE INVENTION

This invention comprises a lock mechanism having a retainer or hasp member which is captured by a latch means that comprises a pair of opposed hooks, one carried on an actuation member and the other carried on a travel latch member that is yieldably interconnected thereto whereby depression of the actuation member moves the hooks in unison and fails to release the hasp member. The actuation mechanism also includes a fixed position abutment with an opposed, moveable abutment carried on the travel latch member but separated therefrom by an actuation cavity. The actuation cavity is in communication with a labyrinth that defines a three-dimensional torturous passageway for a ball. When the latter is advanced through the torturous passageway by movement through an enabling combination of preselected, sequential positions, the ball drops into the actuation cavity where it obstructs the movement of the latch member. In this position, depression of the actuation member with its dependent hook spreads the opposed hooks and releases the hasp member.

BRIEF DESCRIPTION OF THE DRAWINGS

The invention will be described by reference to the drawings of which:

FIG. 1 is a perspective view of the locking box of the invention;

FIG. 2 is a view along lines 2—2 of FIG. 1;

FIG. 3 is a view along lines 3—3 of FIG. 2;

FIG. 4 is a view along lines 4—4 of FIG. 2;

FIG. 5 is a view along lines 5—5 of FIG. 4;

FIG. 6 is a view similar to that of FIG. 5;

FIG. 7 is a perspective view of the labyrinth of the lock mechanism;

FIG. 8 is as view along lines 8—8 of FIG. 7; and

FIGS. 9–11 illustrate the detenting positions of the ball and actuation and latch members.

DESCRIPTION OF THE PREFERRED EMBODIMENTS

Referring now to FIG. 1, the locking box of the invention is shown as a substantially cubic box 10 having a cover 12 received between the upper edges of the upright sidewalls. One of the walls, wall 14, has an aperture 16 which receives the end button 18 of an actuation member for the latch mechanism. Each of the corners of box 10 bears a characteristic indicia 20 which can be a letter, numeral or can be a distinct color to provide a coating of the corners of the box. Letter indicia from A to H are shown in FIG. 1.

Referring now to FIG. 2, there is shown a sectional elevational view along lines 2—2 of FIG. 1. As there shown, the box has opposite, upright sidewalls 22 and 24 secured to a bottom wall 26 which, together with cover 12, define an interior chamber 28 that is subdivided by a transverse internal wall 30 to form a lock mechanism chamber that receives the lock mechanism of the invention.

Cover 12 has a protruding post 32 that is received in aperture 34 in the top edge of wall 24 and, on its opposite edge, has a groove 36 which is traversed by a hasp pin 38.

Hasp pin 38 is captured by a pair of opposed hook members 40 and 42, which are shown in greater detail in FIG. 3. Hook member 40 is secured to actuation lever 44 which extends substantially the interior width of the box and which has opposite, lateral raised edges 46 and 48 that are received in grooves 50 and 52 of the partition 30 and wall 22, respectively. As apparent from FIG. 3, actuation lever 44 carries end button 18 which is received in aperture 16 of sidewall 14.

The undersurface of actuation lever 44 has a wide, transverse slot 54 and a communicating, smaller slot 56. Hook member 42 extends through slot 56 and is attached to latch travel member 58 which also has opposite, lateral raised edges that seat in grooves 50 and 52. The body portion 60 of latch travel member 58 is received within slot 54, partially filling the slot and a resilient member such as a compressible sponge or rubber plug 62 is placed between body portion 60 and face 64 in slot 54 of the latch actuation member 44, thereby providing a yieldable interconnection between these members. A second resilient plug 66 is mounted on the inboard end of actuation lever 44, bearing against the interior wall of upright side 68 to serve as a resilient bias for the actuation lever and dependent buttom 18.

The latch travel member 58 bears, on its undersurface, a dependent bracket 70 which has a travelling abutment surface 72 that is opposed to and spaced apart from a fixed position abutment 74 by an actuation cavity 76. As apparent from FIG. 2, fixed position abutment 74 is fixedly mounted on the inside wall of partition 30.

The actuation cavity 76 receives, in a manner hereinafter described in greater detail, a ball member which fills the cavity and restricts travel of the latch travel member 58 when button 18 is pushed; the relative displacement between the travel member and the actuation member 44 being permitted by the resilient yieldable plug 62. In this fashion, the opposed hook members 40 and 42 can be spread sufficient distance to release hasp pin 38. It is likewise apparent that when the actuation cavity 76 is vacant, the actuation travel member 58 is freely displaceable with displacement of actuation member 44, resulting in no separation of opposed hook members 40 and 42 and no release of hasp pin 38.

The remainder of the lock mechanism comprises a labyrinth that defines a torturous passageway which communicates with actuation cavity 76 and permits advance of the ball into this actuation cavity when the box 10 is through the enabling combination of preselected and sequential positions.

The labyrinth of the three-dimentional torturous passageway includes a subjacent transverse chamber 78 subdivided from a superior chamber 80 by a coextensive partition 82. The subjacent chamber 78 is subdivided by a transverse partition 84 which has an aperture 86; see FIG. 5, to provide a passageway for the actuation ball. The partition 82 has a plurality of ball passing apertures 87 and 88 and corner aperture 90 which appears in FIG. 4 and which provides passage for the ball member into the superior chamber 80. Chamber 80 is subdivided by a plurality of transverse partitions including partition 92 that has a corner aperture 94, shown in FIG. 5. The latter permits passage of the actuation ball into the succeeding chamber 95 which is defined by transverse partition 92 and a successive, transverse partition formed by partial wall 96 and a generally coplanar, opposed wall 98, is shown in FIG. 3. The space above wall 96 defines a ball passing aperture 100 that permits the actuation ball to move into the succeeding chamber 102 which is defined by the transverse wall 104 and the generally coplanar and cooperative wall 106 shown in FIG. 3. Wall 106 has a clearance space above partition 82 to provide a ball passage aperture 108 (shown in FIG. 3) whereby the actuation ball can pass into large cavity 110.

In the preferred embodiment, one of more of the transverse partitions in the subjacent chamber 78 or superior chamber 80 is removeable and can be reversed, end-to-end or inverted or can be interchanged with other transverse partitions. This flexibility is shown in FIGS. 5 and 6 where the partitions 84 and 92 are shown received in grooves 112 and 114 in wall 22. The partitions are secured in this position by a lock pin 116 which is received in a bore 117. The reversability of these partitions 84 and 92 is illustrated in FIG. 6 where partition 84 is reversed end-to-end and inverted to locate aperture 86 at the lower left rather than upper right, as shown in FIG. 5. In a similar fashion, partition 92 can be reversed or even replaced with an interchangeable wall thereby changing the enabling combination of positions.

The apertures 87 and 88 in partition 82 serve as bypass or shunt passageways for the actuation ball and provide a further complexity in the operation of the lock mechanism for successful passage of the actuation ball into the actuation cavity 76.

The travel of the actuation ball and interrelationship of the partitions of the labyrinth can be better described with reference to FIG. 7. As there illustrated, the labyrinth portion is shown as enclosed by imaginary planes which are formed by the interior sidewalls of the interior partition 30 and 30*a*, and opposed side interior surface of sidewall 22 and the interior walls of the opposite sides of the box. The actuation ball 118 is shown in solid lines in the actuation cavity and in broken lines in the subjacent chamber 78.

The first movement of the box is made to locate aperture 86 of partition 84 at a low point to permit ball 118 to roll through the aperture and into the small subjacent cavity 85. The box is then rotated to place aperture 90 of partition 82 at a lowermost elevation, permitting the ball 118 to pass into chamber 80 from which the ball can be passed through aperture 94 in partition 92 into chamber 95. The ball can then be passed through aperture 100 in the partition formed by coplanar partial walls 96 and 98 into chamber 100 from where the ball can be passed through aperture 108 formed by the coplanar partial walls 106 and 104.

As the ball enters the large cavity 110, it is important that button 18 of the actuation lever 44 not be depressed so that post 120, which is carried on the undersurface of travel member 58 will be in the illustrated position which obstructs aperture 88 and prevents the actuation ball 118 from passing through this shunting aperture, retaining the ball within chamber 110 rather than permitting it to fall into the subjacent chamber 78. Aperture 87 also serves as a shunting aperture that will permit the ball to fall into chamber 78 if the box is wrongly positioned with aperture 78 at the lower corner. The proper rotation of the box will cause the actuation ball to pass about post 122 carried on the undersurface of actuation member 44 from where the ball can be moved, again upon proper rotation of the box and pressing of button 18, into the actuation cavity 76 between fixed position abutment 74 and the abutment surface 72 of block 70 carried on the undersurface of the travel member 58.

FIG. 8 illustrates a preferred construction for the undersurface of the partition 82 which has raised lips 124 and 126 surrounding both apertures 87 and 88, thereby preventing bypassing the previously described labyrinth by dropping the actuation ball from cavity 78 directly into the large cavity 110.

FIGS. 9 through 11 illustrate the last steps of the unlocking of the box. The ball 118 is prevented from entering the actuation cavity 72 by post 122 that is carried on the undersurface of actuation member 44. To permit the ball to be received in this actuation cavity, it is necessary to press button 18 and move the actuation member 44 with its associated post 122 a sufficient distance shown in FIG. 10 to permit the ball 118 to be received in groove 126. The button 18 is then relaxed, permitting the resilient block 66 to return the button and move the actuation member 44 into the position shown in FIG. 11 where the ball 118 is free to fall into the actuation cavity 76, captured between the fixed abutment 74 and the abutment surface 72 on the moveable abutment 70 that is carried on the undersurface of the latch travel member 58. As apparent from FIG. 3, depressing the button 18 will move actuation member 44 relative to the obstructed travel member 58 and spread hook members 40 and 42 sufficiently to release hasp pin 38.

The enabling combination of box positions based on the FIG. 1 indicia is as follows, with each letter designating the high corner of the box: H, F, H, A, D, C, B, C, D, A, H, F, PUSH BUTTON 18, O, G, RELEASE BUTTON 18, H, PUSH BUTTON 18. The box can be relocked with the G corner uppermost, insert lever 12 and press button 18, then rotate the box to elevate corners C and B in sequence and push botton 18. When button 18 is pushed, the ball is freed to clear post 122 and falls into chamber 110. With the B corner elevated, the ball will roll to aperture 87 and fall therethrough, into subjacent chamber 78.

The three-dimensional character of the labyrinth provides a maximum of positions of the box and permits each corner to be assigned an indicium such as an identifying number or color to provide a maximum number of possible combinations. The complexity of enabling combination of box positions is further increased by the necessity to depress and release the actuating button at the proper timing.

The invention has been described with reference to the illustrated and presently preferred embodiment. It is not intended that the invention be unduly limitied by this description. Instead, it is intended that the invention be defined by the means, and the obvious equivalents, set forth in the following claims.

I claim:

1. A locking box having an opening closed by a cover secureable in a position closing said opening and a lock mechanism requiring movement through an enabling combination of a plurality of preselected, sequential positions which comprises:

a retainer member carried on the inside wall of said cover;

a latch member carried by said box and moveable between a first position capturing said retainer member and a second position releasing said retainer member;

latch actuation means including an actuation member and a ball member received in an actuation cavity to operatively interconnect said actuation member and said latch member;

labyrinth means received within said box and accessible only through said opening including a plurality of ball receiving channels formed by at least one chamber subdivided by a plurality of transverse partitions having ball passing apertures at diverse locations to define a continuous, three dimensional torturous passageway having cross passageways at mutually perpendicular orientations with at least one of said transverse partitions being removeably received in said chamber thereby permitting fixed adjustability of said latch enabling combinations; and a ball obstruction in said passageway and means interconnected with said actuation means and operative to remove said ball obstruction and permit ball access through said passageway.

2. The lock mechanism of claim 1 wherein said latch member comprises a pair of opposed hook members, one carried on said actuation member and the other on a latch travel member moveably mounted in said latch actuation means and yieldably interconnected to said actuation member;

fixed position abutment means; and movable abutment means carried by said latch travel member, opposed to said fixed abutment means but separated therefrom by said actuation cavity.

3. The lock mechanism of claim 1 wherein said at least one removable partition is reversible.

4. The lock mechanism of claim 1 wherein said at least one removable partition is one of a plurality of interchangeable partitions.

5. The lock mechanism of claim 1 wherein two or more of said partitions are removable and interchangable.

6. The lock mechanism of claim 1 wherein said labyrinth includes a ball shunting passageway.

7. The lock mechanism of claim 1 wherein said passageway has lateral dimensions substantially greater than the diameter of said ball whereby said ball has freedom of movement in three dimensions within said passageway.

8. The lock mechanism of claim 1 wherein said at least one removeable partition is invertible.

9. A locking box having an opening closed by a cover secureable in a position closing said opening and a lock mechanism requiring movement through an enabling combination of a plurality of preselected, sequential positions which comprises:

a retainer member carried on the inside wall of said cover;

a latch member carried by said box and moveable between a first position capturing said retainer member and a second position releasing said retainer member;

latch actuation means including an actuation member and a ball member received in an actuation cavity to operatively interconnect said actuation member and said latch member;

labyrinth means received within said box and accessible only through said opening including a plurality of ball receiving channels formed by at least one chamber subdivided by a plurality of transverse partitions having ball passing apertures at diverse locations to define a continuous, three dimensional torturous passageway having cross passageways at mutually perpendicular orientations with at least one of said transverse partitions being removeably received in said chamber thereby permitting fixed adjustability of said latch enabling combinations; and a ball shunting passageway interconnecting intermediate locations of said torturous passageway with ball deflecting means interconnected to said actuation means and moveable therewith into a position permitting access to said shunting passageway.

* * * * *